US005584269A

United States Patent [19]

MacKenzie

[11] Patent Number: 5,584,269

[45] Date of Patent: Dec. 17, 1996

[54] ENGINE BLOCK HEATER

[76] Inventor: Brian MacKenzie, MacKenzie Drilling Ltd. Box 53,, Timmins, Ontario, Canada, P4N 7C5

[21] Appl. No.: 587,689

[22] Filed: Jan. 17, 1996

[30] Foreign Application Priority Data

Jan. 20, 1995 [CA] Canada ..... 2140732

[51] Int. Cl.[6] ..... F02N 17/02

[52] U.S. Cl. ..... 123/142.5 R; 237/12.3 C; 122/136 R; 122/142

[58] Field of Search ..... 123/142.5 R; 237/12.3 C, 237/2 A; 126/110 B, 110 D; 122/136 R, 142

[56] References Cited

U.S. PATENT DOCUMENTS

| | | | |
|---|---|---|---|
| 4,348,992 | 9/1982 | Southard | 123/142.5 R |
| 4,392,609 | 7/1983 | Conterio | 237/12.3 C |
| 4,397,288 | 8/1983 | Kelling | 123/557 |
| 4,445,469 | 5/1984 | Suhayda | 123/142.5 R |
| 4,520,769 | 6/1985 | Kratzer | 123/142.5 R |
| 4,762,488 | 8/1988 | Schilling | 431/350 |
| 4,815,426 | 3/1989 | Henschel | 123/142.5 R |
| 5,005,542 | 4/1991 | Rissanen | 123/142.5 R |
| 5,021,633 | 6/1991 | Schaefer | 219/208 |
| 5,117,556 | 6/1992 | Schaefer | 29/888.01 |

OTHER PUBLICATIONS

TEMRO 1993 Product Catalogue, Cover page & p. 12.

*Primary Examiner*—Erick R. Solis

[57] ABSTRACT

An engine block heater comprising a propane circulation heater in which engine coolant is heated in a jacket surrounding an inner chamber which is open at both ends to accommodate an industrial size portable propane torch. The jacket is inclined to the horizontal and has a coolant inlet and a coolant outlet which, in use, are connected to the engine block. When the torch is lit, coolant from the engine flows, driven by natural convection forces so that cold coolant from the engine is replaced with heated coolant.

7 Claims, 1 Drawing Sheet

ENGINE BLOCK HEATER

FIELD OF THE INVENTION

This invention relates to an engine block heater of the kind in which engine coolant is heated through a heat exchanger and finds particular application for starting heavy equipment in extreme cold temperatures.

BACKGROUND OF THE INVENTION

Commercially-available devices of this kind are very slow working in cold temperatures and are undependable. For example, logging equipment is often badly damaged due to mechanical failure of these devices. Engines have been known to be set on fire by some of these devices and other devices suffer from the disadvantage of being mechanically complicated and are therefore insufficiently rugged to take the abuse of the bush environment.

The object of this invention is to provide a mechanically simple engine block heater which is easy to use and which overcomes, at least in part, the aforementioned disadvantages.

SUMMARY OF THE INVENTION

In accordance with this invention, there is provided an engine block heater which, in use, is coupled to the engine coolant system. The heater comprises a jacket which has an inner chamber that is open at both ends to receive a source of external heat, preferably an industrial-size portable propane torch. The outer jacket has coolant inlet means for receiving cool engine coolant from the engine block and coolant outlet means for delivering heated engine coolant back to the engine block.

Preferably, the jacket is inclined to the horizontal so that it has an upper end and a lower end and the coolant inlet is disposed at the lower end, while the coolant outlet is disposed at the upper end so that the coolant will flow through a coolant chamber defined between the jacket driven by natural convection forces from the inlet means to the outlet means and replace coolant received from the engine block with heated coolant.

Maximum exposure to the heat source is provided by a plurality of spaced conduits which traverse the inner chamber and are in fluid communication with the outer jacket.

BRIEF DESCRIPTION OF THE DRAWINGS

In order that the invention may be more clearly understood, it is described in further detail below with reference to a preferred embodiment illustrated in the accompanying drawings, of which

DESCRIPTION OF PREFERRED EMBODIMENT WITH REFERENCE TO DRAWINGS

Figures 1, 2:
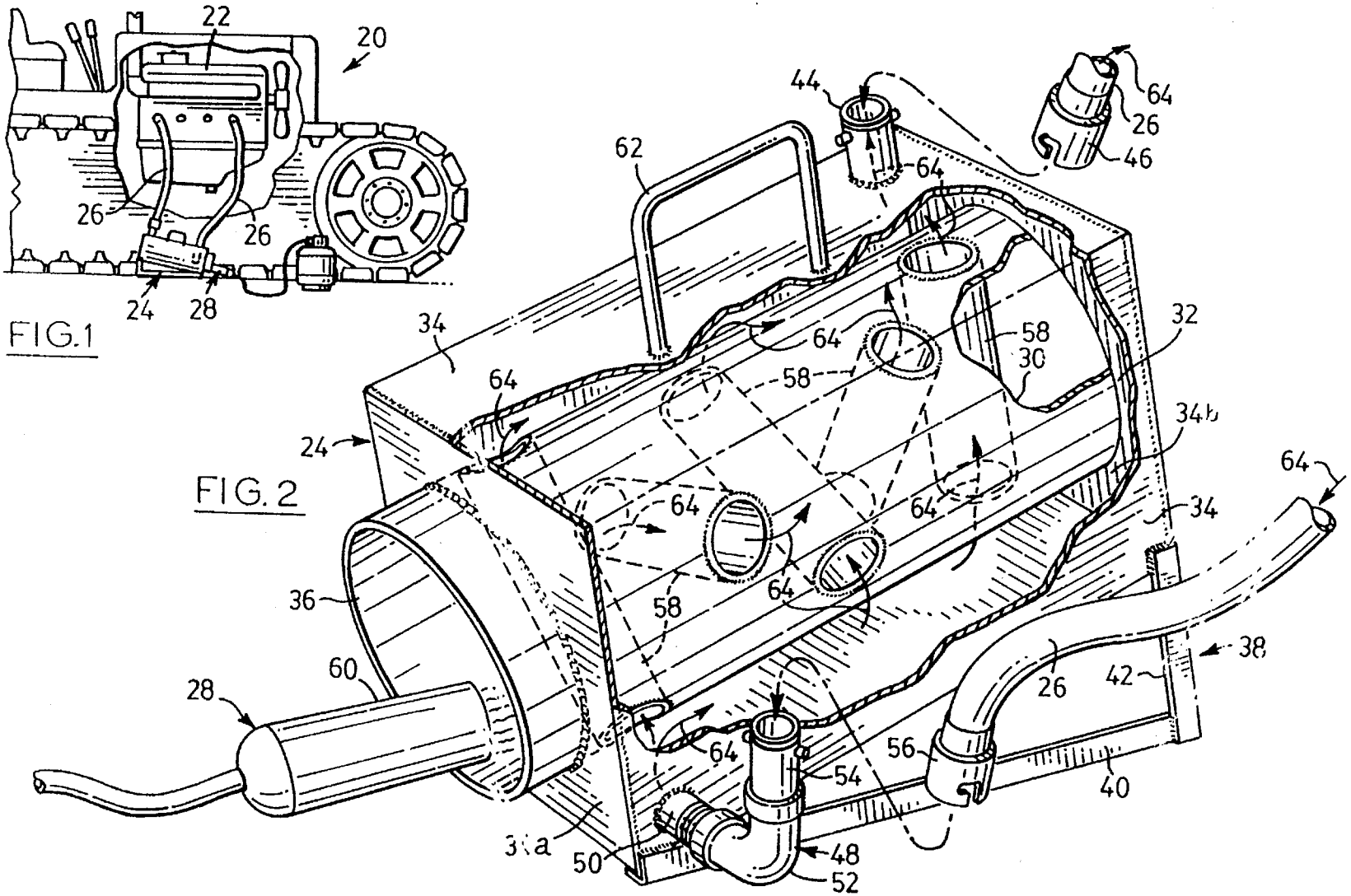
FIG. 1 is a schematic drawing showing the heater according to the invention coupled to an engine block.
FIG. 2 is a perspective view of the heater according to the invention in which portions of an outer jacket comprising the heater have been broken away to reveal the internal structure of the heater.

Referring firstly to FIG. 1, there is illustrated by way of example, a motorised vehicle 20 of the kind driven to move over surfaces by means of an endless track and typically used on construction sites. The vehicle 20 is typical of the heavy equipment for which the engine block heater, according to the invention, is intended. The engine block for the vehicle 20 is indicated by numeral 22 and is shown coupled to the heater 24 in accordance with the invention by a pair of coolant hoses 26. An external heat source in the form of a portable industrial-size propane torch 28 is used with the heater in accordance with the invention and is indicated by numeral 28 in FIG. 1.

Turning now to FIG. 2, the engine block heater 24 comprises an inner cylindrical chamber 30 having a longitudinal axis and having two ends which are open. A jacket 32 which is disposed about the inner chamber so as to surround the inner chamber while leaving the ends open. Outer walls for the jacket 32 are defined by six rectangular panels 34 disposed around the inner chamber so as to form a box and a coolant chamber is defined between the jacket and the inner cylindrical chamber 30.

The end panels **34*a* and 34*b* are apertured to receive the cylinder defining the inner chamber 30 and which protrudes through end panel 34*a* to define a collar 36**.

It will be understood that both the inner chamber 30 and the outer jacket 32 may have different shapes, the ones shown here having been selected for convenience in the construction of a prototype made from steel plate ⅛" (3mm.) thick.

A pair of angle supports 38 (of which only one is shown in FIG. 2) each comprising a horizontal leg 40 joined to a vertical leg 42 have their free ends welded to the panels 34 comprising the outer jacket 32 so as to elevate the end of the jacket remote from the collar 36. On the upper panel 34 at said elevated end of the jacket 32, an opening is formed to receive a tubular connection having oppositely-disposed lugs and defining coolant outlet means 44 which terminates in the coolant chamber defined between the jacket 32 and the inner cylindrical chamber 30 to be in direct fluid communication therewith. The coolant outlet 44 is adapted to cooperate with a notched coupling 46 disposed at one end of one of the hoses 26 connecting the heater 24 to the engine block 22 (FIG. 1).

A coolant inlet 48 is disposed in an aperture formed in the lower end of the outer jacket 32 on the opposite side of the inner chamber 30 and also terminate in the afore-mentioned coolant chamber to be in direct fluid communication therewith. The coolant inlet comprises a short length of threaded pipe 50, a threaded elbow 52 and a tubular fitting 54 having oppositely-disposed lugs similar to the coolant outlet 44, and adapted to cooperate with a notched coupling 56 disposed at one end of the other hose 26 which is attached to the engine block 22 (FIG. 1).

Five tubular conduits 58 traverse the inner chamber 30 and terminate in the afore-mentioned coolant chamber so as to be in direct fluid communication therewith. The conduits 58 comprise short lengths of pipe equally spaced along the length of the inner chamber 30 and angularly staggered with respect to one another so as to maximize the surface area exposed to a heat source applied to the inner chamber.

The propane torch 28 is used to supply the required heat and is disposed with its nozzle 60 supported inside the inner chamber 30 on the collar 36.

Conveniently, a length of steel rod is shaped into a handle 62 and welded to the upper panel 34 defining the outer jacket for the heater 24.

In use, the heater 24 is brought to the site where it is required and coupled to the engine block, using a pair of hoses 26. The coolant chamber defined between the outer jacket and 32 the inner chamber 30 and any conduits 58 are filled with coolant, and preferably the hoses 26 are also filled with coolant so as to minimize the occurrence of any airlocks in the coolant flow circuit between the heater 24 and the engine block 22. It will be understood that the coupling block 22 used at the engine block will free the engine coolant so that it can readily flow through the hoses 26.

A portable propane torch is brought to the site and ignited. With the torch nozzle 60 disposed inside the collar 36, the flame length is adjusted to penetrate the length of the inner chamber 30 and to surround the conduits 58. Coolant from the engine block flows through the hoses 26 and enters the heater 24 through the inlet 48 where it is heated and rises through the conduits and around the inner chamber to exit from the outlet 44 driven by natural convection forces. In this way, heated coolant is brought to the engine block where it replaces colder coolant which continues to flow as indicated by the arrows 64 through the heater 24.

It will be understood that the elegance of this invention resides in its simplicity. The heater, according to the invention, requires no moving parts, no pump or battery being required to circulate the coolant through the apparatus which, in essence, is a heat exchanger. Furthermore, it will be appreciated that coolant from the engine block is constantly circulating through the heater according to the invention and therefore the heater is self-cooling. Finally, a forced external heat source in the form of a propane heater is well-known to be reliable and also easily accessible in remote locations where such heavy equipment is required.

A prototype for the invention constructed from welded steel plate had outer dimensions of 7"×7"×14" for the jacket 30 and an inner chamber with a 5½" diameter. The conduits 58 were fabricated from 1½" diameter pipe spaced three inches apart and radiating at 36° from the centre of the inner chamber. The heater had a total weight of approximately 30 lbs (13.6 kilos). It is estimated that the prototype heater had a capacity for circulating 1 gallon of glycol coolant per minute. Because of its rugged construction, the heater could bounce around on equipment or trucks all day with no detrimental effects. In one field test, a Caterpillar [198] D-6 tractor, which had been idle for two weeks, was successfully started at an ambient temperature of −35° Celsius after the heater was operated for only 30 minutes. This is a considerable improvement over available prior art devices in which several hours of operation are required to achieve the necessary conditions for starting an engine in extreme cold temperatures.

The advantages of the invention are therefore easily manifested in its ease of operation and ease of care and maintenance. However, its most attractive attribute is that it will operate very quickly and achieve the required results within short delays, thereby allowing the heavy equipment operator to make use of his equipment as required, on short notice.

I claim:

1. An engine block heater comprising:

an inner chamber having two open ends and adapted to accommodate an external heat source;

an outer jacket disposed about the inner chamber and adapted to surround the inner chamber while leaving said ends open, and inlet means and outlet means adapted to be coupled to an engine block and to receive engine coolant when the heater is in use and an external heat source is applied to the inner chamber, said inlet means and said outlet means both terminating in a coolant chamber defined between said outer jacket and said inner chamber so as to be in direct fluid communication therewith.

2. An engine block heater according to claim 1 in which the inner chamber is adapted to receive the nozzle of a portable propane torch at one end and to exhaust combustion gases at the other end.

3. An engine block heater according to claim 1 in which the outer jacket is inclined to the horizontal so as to have an upper end and a lower end, and the coolant inlet means is disposed at the lower end while the coolant outlet means is disposed at the upper end remote from the coolant inlet means so that coolant will flow, driven by natural convection forces from the inlet means to the outlet means.

4. An engine block heater according to claim 1 having a plurality of spaced conduits traversing the inner chamber and in fluid communication with the coolant chamber.

5. An engine block heater comprising:

an inner chamber having a longitudinal axis, open at two ends and adapted to receive an external heat source;

an outer jacket disposed about the inner chamber and adapted to surround the inner chamber while leaving said ends open;

coolant inlet means terminating in a coolant chamber defined between said outer jacket and said inner chamber so as to be in direct fluid communication therewith, the coolant inlet means being adapted to be coupled to an engine block and to receive cool engine coolant from the engine block;

coolant outlet means disposed above said coolant inlet means terminating in said coolant chamber so as to be in direct fluid communication therewith, the coolant outlet means being adapted to be coupled to an engine block and to deliver heated engine coolant to the engine block; and a plurality of conduits spaced longitudinally along said axis, the conduits having oppositely-disposed ends terminating in said coolant chamber so as to be in direct fluid communication therewith so that, upon the application of heat to the inner chamber, engine coolant will flow, driven by natural convection forces from the inlet means to the outlet means and replace coolant received from the engine block with heated coolant.

6. An engine block heater according to claim 5 in which the said conduits are angularly staggered with respect to one another on said longitudinal axis so as to maximize the surface area of conduit exposed to a heat source when the heater is in use.

7. An engine block heater comprising:

an inner chamber having a longitudinal axis, open at two ends and adapted to receive an external heat source;

an outer jacket disposed about the inner chamber and adapted to surround the inner chamber while leaving said ends open;

coolant inlet means in fluid communication with a coolant chamber defined between said outer jacket and said inner chamber, the coolant inlet means being adapted to be coupled to an engine block and to receive cool engine coolant from the engine block;

coolant outlet means disposed above said coolant inlet means in fluid communication with said coolant chamber, the coolant outlet means being adapted to be coupled to an engine block and to deliver heated engine coolant to the engine block; and a plurality of conduits spaced longitudinally along said axis, the conduits being angularly staggered with respect to one another on said longitudinal axis and having oppositely-disposed ends in fluid communication with said coolant chamber so as to maximize the surface area conduit exposed to a heat source when The heater is in use and so that, upon the application of heat to the inner chamber, engine coolant will flow, driven by natural convection forces from the inlet means to the outlet means and replace coolant received from the engine block with heated coolant.

* * * * *